US005996907A

United States Patent [19]

Toetschinger et al.

[11] Patent Number: 5,996,907

[45] Date of Patent: Dec. 7, 1999

[54] PORTABLE WASH AND RINSE SYSTEM WITH DILUTION

[75] Inventors: Mark J. Toetschinger, New Hope; Mary M. Dawson, Lakeville, both of Minn.

[73] Assignee: Ecolab Inc., St. Paul, Minn.

[21] Appl. No.: 09/033,229

[22] Filed: Mar. 2, 1998

[51] Int. Cl.[6] ..... B05B 12/14

[52] U.S. Cl. ..... 239/305; 239/318; 239/443

[58] Field of Search ..... 239/304, 305, 239/312, 318, 335, 443, 722

[56] References Cited

U.S. PATENT DOCUMENTS

| | | | |
|---|---|---|---|
| 3,380,658 | 4/1968 | Stasz et al. | 239/305 X |
| 3,454,042 | 7/1969 | Phillips | 137/565 |
| 3,556,402 | 1/1971 | Wolking | 239/304 X |
| 3,589,614 | 6/1971 | Linville | 239/142 |
| 3,680,786 | 8/1972 | Levy | 239/146 |
| 3,894,690 | 7/1975 | Hill | 239/126 |
| 3,900,165 | 8/1975 | Parke et al. | 239/375 |
| 3,909,197 | 9/1975 | Cremers | 8/158 |
| 3,964,689 | 6/1976 | Horvath, Jr. | 239/318 |
| 4,182,491 | 1/1980 | Parke et al. | 239/11 |
| 4,208,013 | 6/1980 | Coleman et al. | 239/351 |
| 4,621,770 | 11/1986 | Sayen | 239/304 |
| 4,790,454 | 12/1988 | Clark et al. | 222/136 |
| 4,865,255 | 9/1989 | Luvisotto | 239/722 X |
| 4,967,960 | 11/1990 | Futrell | 239/148 |
| 5,029,758 | 7/1991 | Chayer | 239/318 X |
| 5,100,059 | 3/1992 | Englhard et al. | 239/310 |
| 5,213,263 | 5/1993 | Corona | 239/304 |
| 5,259,557 | 11/1993 | Spriggs et al. | 239/318 X |
| 5,263,223 | 11/1993 | Fiegel et al. | 15/321 |
| 5,421,900 | 6/1995 | Clontz | 134/14 |

*Primary Examiner*—Lesley D. Morris
*Attorney, Agent, or Firm*—Merchant & Gould P.C.

[57] ABSTRACT

The system of the invention comprises a container with a spout that can be filled with water from a tub. The container having a housing positioned above the container for electrical and pumping components. The housing comprises a dry side and a wet side and a source of liquid cleaner concentrate. The wet side is proximate the container and diluent water. The system also comprises a spray wand that can be used to spray both cleaner and rinse water on a cleanable surface. The housing comprises a wet portion containing a pump drive and tubing providing liquid communication between the container, source of aqueous concentrate and diluent, venturi and liquid communication to a spray head. The dry side containing wiring switches, rechargeable batteries and other electrical systems. The system is easily portable, easily filled with service water which can be easily poured from the system after use, is rechargeable and can be used in cleaning hospitality, institutional and commercial showers, tubs, sinks, counters, mirrors, walls, floors and other cleanable surfaces.

17 Claims, 6 Drawing Sheets

PORTABLE WASH AND RINSE SYSTEM WITH DILUTION

FIELD OF THE INVENTION

The invention relates to a fully integrated dilution station using a unique combination of mechanical, electrical and liquid elements in a station having a defined wet section and a dry section that combines an aqueous diluent with a liquid concentrate to form a cleaner composition that is sprayed or formed onto a surface. The dilution station can also pump and spray the aqueous diluent as a spray rinse. The dilution station has a container for the aqueous diluent that is designed and configured to be fillable from a tub spout and to be easily emptied without disassembly when cleaning is finished. The integrated unit has one, two or more sources of liquid concentrate and an associated venturi for diluting and spraying each concentrate. The integrated system is powered by a portable power source such as an electric pump and a rechargeable battery having sufficient electrical capacity to enable a custodial or maintenance personnel to complete a substantial number of cleaning tasks between recharging or replacing the batteries.

BACKGROUND OF THE INVENTION

In hospitality, hospital and other residential room maintenance, a substantial amount of time is spent by individual maintenance personnel in cleaning bathroom surfaces such as shower stalls, bathtubs, mirrors, vanities and stools. Bathroom maintenance is commonly conducted on a daily basis if the bathroom is in use. Bathroom maintenance can occupy up to 50% of the time required to complete the daily cleaning of the typical hospitality unit. Cleaning a bathroom is highly labor intensive and involves numerous steps in removing gross soils such as paper products including tissues, spills, shampoo, toothpaste containers, etc. After the initial preparation, maintenance personnel apply cleaners from aerosol or pump sprayers to the surfaces in the bathroom. Cloths, scrubbers, brushes, etc. are then used to apply mechanical action to the surfaces and cleaning materials to remove surface soil. Once the cleaners and soils have been applied by the maintenance personnel, the surfaces are often rinsed and manually dried. Such a procedure is time intensive and, under time pressure, often maintenance personnel reduce attention or can skip one or more steps leaving an incompletely cleaned unit. In bathroom maintenance, cleaning materials are most commonly applied using pressurized aerosol sprays and hand pump sprayers. Rinse water is typically taken from the sink or tub and cleaning cloths, scrub brushes and scrub pads are used to implement soil removal. These maintenance problems are present in maintaining public restrooms in service stations, theaters and other comfort and equivalent locations of public access. Further, institutional and commercial restaurant spaces require at least daily cleaning and maintenance. Further, entryways, windows, food and beverage manufacturing facilities, surgical suites, examining rooms and other locations require cleaning that involve extensive, time-consuming, manual cleaning.

A number of spray systems are known. A large number of systems that can provide a diluted product in a spray form from a concentrate and a diluent have been used in a number of applications. Such systems dispense varied products including adhesives, insecticides, coatings, lubricants and many other varied aqueous and non-aqueous materials. Such products are often blended on site from reactive or non-reactive chemicals and liquid diluents or extenders. In large part, these systems deliver large quantities of materials, have substantially high pressure apparatus that can dispense and are used in painting, agricultural or automotive applications. Such relatively high volume, high pressure pump sprayers are a widely utilized apparatus, for applying a variety of materials, that pose substantial operating problems. The systems are hard to move, difficult to fill, are not applicable to hard surface cleaners or rinse systems, often cannot simply dilute a concentrate, often require a predetermined mix of chemicals, use high pressure pumps, specialized lines and spray apparatus. Levy, U.S. Pat. No. 3,680,786 teaches a mobile cleaning apparatus on a roller frame having an undifferentiated pump and spray portion and a complex system for blending and dispensing liquid materials. Luvisotto, U.S. Pat. No. 4,865,255 discloses a self-contained mobile spraying apparatus for herbicides, insecticides, fungicides, fertilizers and others including an undifferentiated pump and spray system. Fiegel et al., U.S. Pat. No. 5,263,223 disclose an apparatus for cleaning interior surfaces that is a large ungainly device having an undifferentiated pump and spray portion in a non-refillable source of aqueous diluent. Other spraying devices are disclosed in Park et al., U.S. Pat. No. 4,182,491 which discloses a spraying apparatus including a compressed air source, an undifferentiated source of diluent, etc. Horvath, U.S. Pat. No. 3,964,689 discloses a spray apparatus for dispensing a variety of substances. Coleman, U.S. Pat. No. 4,208,013 describes a portable chemical spraying apparatus with a disposable container using compressed air and a preselected chemical composition. Park et al., U.S. Pat. No. 3,900,165 disclose a hand carrier spraying apparatus using pressurized air. Phillips, U.S. Pat. No. 3,454,042 discloses a portable car wash machine using an external water source. Hill, U.S. Pat. No. 3,894,690 describes a complex spraying system for mixing water and a variety of chemicals.

Clark et al., U.S. Pat. No. 4,790,454 discloses a self-contained apparatus, that cannot be easily filled and emptied, used for admixing a plurality of liquids. Further, the pumping section does not contain a differentiated wet and dry portion separating the battery pump and wiring from the wet side of the pump tubing and connectors. Clontz, U.S. Pat. No. 5,421,900 discloses a self-contained battery operated spray unit and method for using the same for cleaning air conditioners. The system comprises containers that are not easily fillable and emptiable and further contains an undifferentiated spray and pumping section in which there is no defined wet and dry portion.

A substantial need exists to improve cleaning processes in the hospitality bathroom and other similar locations of daily manual maintenance. A substantial need exists to reduce the time and effort required to complete such a cleaning process. A substantial improvement in the application of cleaners to hard surfaces is needed to ensure that each bathroom is cleaned satisfactorily for the user. Further, any improvement in productivity will be welcomed by the guests and hotel management.

BRIEF DISCUSSION OF THE INVENTION

The invention comprises an integrated system that can be used in daily manual hospitality, institutional or industrial cleaning of bathrooms kitchens or other similarly situated locations. The system can be used to spray a cleaning composition onto soiled surfaces and to spray an aqueous rinse onto the cleaned surface producing a dry spot-free surface. The system comprises a container, having a base. The container is shaped and configured such that the container can rest upright on its base and can be easily filled without disassembly from an available water source with an aqueous diluent. The system combines the aqueous diluent with a concentrate for cleaning. The system uses the aqueous diluent as a spray rinse. When cleaning is complete the container portion of the system is easily emptied into a bathtub, sink or other place of disposal without disassembly.

Mounted above the diluent container, in the system, is a dilution section having a defined dry portion for electrical components separated from a defined wet portion for the wet input part of the pump and associated tubes, etc. The wet portion is proximate the container and the container aqueous liquid diluent contents, if any. The dilution section comprises a pump, the pump also having a wet portion and a dry portion appropriately positioned in the dry and wet portion. The dry portion of the dilution section comprises a rechargeable battery, switches, circuitry and sufficient wiring to operate the pump appropriately in cleaning operations. The dry, electrical portion of the pump is fixed in the dry portion of the dilution section and comprising the electrical drive means and electrical connections. The wet portion of the dilution section comprises the wet part of the pump and liquid communication lines and a venturi. The wet portion of the pump is fixed in place in the wet portion of the dilution section and comprises the pumping portion and liquid communication inlets and outlets. The integrated system further comprises a spray head, in liquid communication with the venturi outlet, configured in such a way that the spray head can spray both dilute liquid cleaner and aqueous diluent rinse onto a target surface. The venturi picks up concentrate form the concentrate source. The pump passes water through the venturi causing the venturi to pickup and dilute concentrate. The pump derives water from the container. A variety of spray patterns and directions can be implemented. The system can have one, two or more tandem pumping circuits for one ore more sources of liquid concentrates. The rechargeable battery can be charged by plugging a charger cord into the system charging the battery in place. Alternatively, the rechargeable battery can be shaped and configured for removal from the dilution unit for charging in a separate charger station.

In use, maintenance personnel will move the dilution unit or system from room to room. In the cleaning process, in a (e.g.) bathroom, maintenance personnel will fill the container from a source of service water such as a tub spout. When sufficient water is placed in the unit, the unit can be moved to a convenient location for use. The pump, can be energized, drawing water from the container, passing the water through the venturi drawing aqueous concentrate through the venturi for dilution in the aqueous stream. The diluted concentrate passes into and out of the spray head onto a target surface. The maintenance personnel can use the spray to wet and cover soiled surfaces with the spray cleaner material. The spray cleaner material is formulated for removal of common soils in bath tub, vanity and stool cleaning. The cleaner is left in contact with the soiled surfaces for a sufficient period of time to permit the cleaner formulation to sufficiently remove soil from the surface such that it can be removed with an aqueous rinse. The spray head is then configured with a two way valve or reconnection feature to deliver only an aqueous rinse pumped directly from the container and pump to the clean surfaces. The pump is energized and water is passed from the container through the pump into the spray and onto the cleaned wall surfaces. The spray rinses cleaner and removed soil from the surface leaving a clean dry surface. The cleaner formulations are carefully made and include a rinse agent composition that ensures that the aqueous rinse, as it is removing cleaner and soil from the wall, sheets and drains from the wall surface leaving no spotting or streaking. No follow up hand wiping is required to complete the process. Such a process substantially improves the productivity of maintenance personnel because to spray on, let set, and rinse off the cleaning composition from shower tile, tub, vanity and stool surfaces can be done rapidly without substantial effort by personnel. Such a process can reduce the amount of time expended by maintenance personnel in cleaning the bathroom by a significant factor. The dilution system of the invention can contain one, two or more aqueous concentrates for cleaning different soils or surfaces if needed.

BRIEF DISCUSSION OF THE DRAWINGS

FIG. 1 is an isometric view of one embodiment of the apparatus of the invention. The assembled system is shown with the container, the dilution section having a wet and dry portion and the spray head.

FIG. 2 is an exploded isometric view of the components of the dilution system of the invention. FIG. 2 shows the container for the aqueous diluent, the wet and dry portion of the dilution section and a housing that encloses the dilution section with integral molded handles, locations for switches, a plug for charging the rechargeable batteries, a station for the concentrate container and a holster for the spray head.

FIG. 3 is an electrical diagram of the simple electrical circuit of the system of the invention.

FIG. 4 is an isometric view of a second embodiment of the apparatus of the invention. The assembled apparatus has two sources of concentrate. For each concentrate the apparatus has tandem venturis (energized by one or more pumps), diluent tubes and connections to the spray wand. The wand is valved for spray of the selected diluted concentrate or the aqueous spray. The container or bucket portion has a separate wet and dry portion for the liquid diluent and electrical components.

FIG. 6 shows a tandem apparatus for diluting and spraying the liquid concentrate.

DETAILED DISCUSSION OF THE INVENTION

Figure 1:
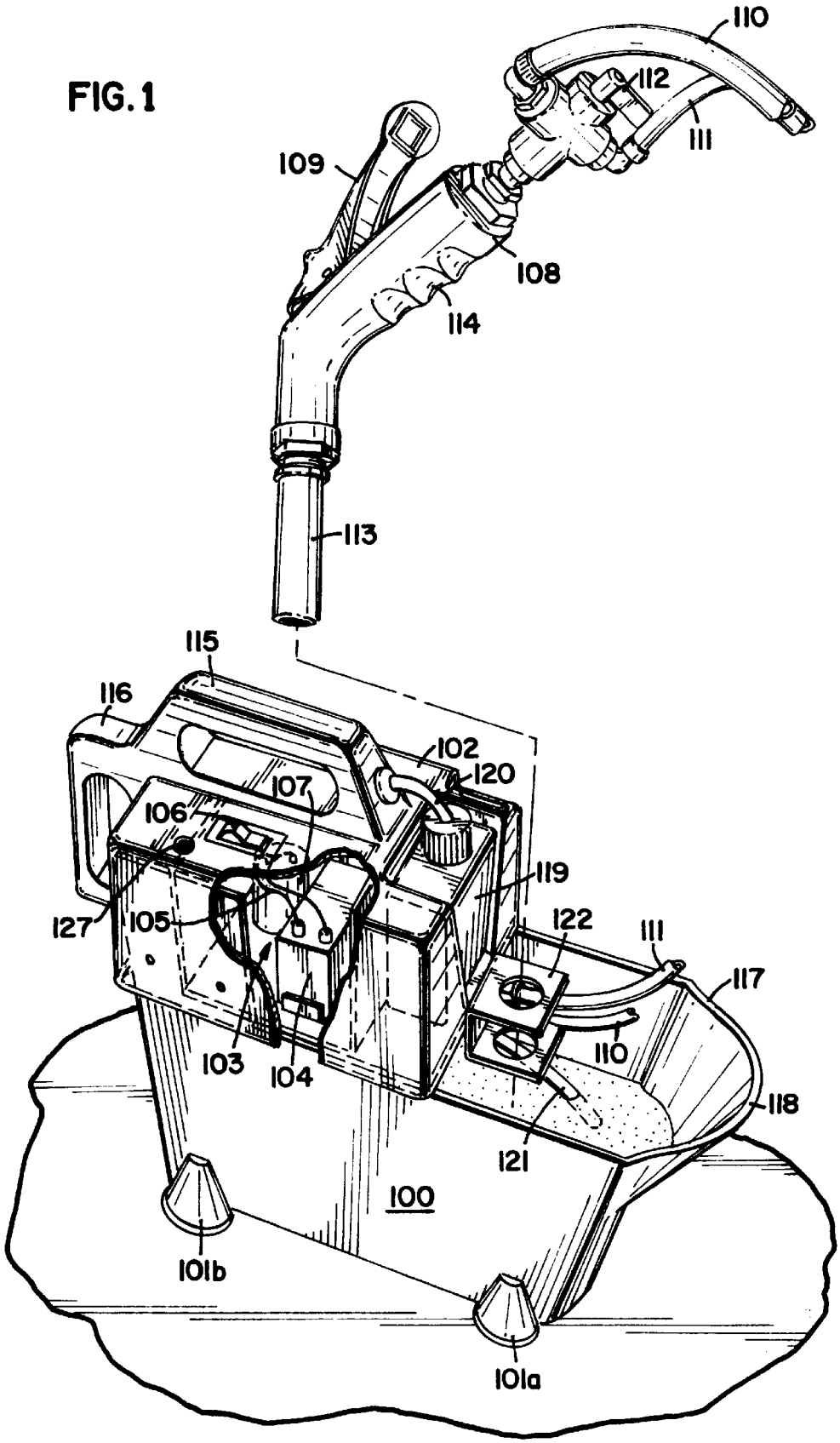

FIG. 1 shows a spray head 113 connected to the pump output of the dilution section. Two sources 110 and 111 are shown for the diluted concentrate and the rinse. The spray is energized by compressing handle 109 which permits either rinse or diluted concentrate to exit the spray head in a spray pattern. The rinse or the diluted concentrate is selected using valve 112. The spray head is typically constructed from conventional metallic and thermoplastic materials. The spray head can be adapted for one, two or more diluted concentrate streams and a rinse stream. The selection of the rinse or diluted concentrate stream can be made at valve 112 in the spray head or in the dilution section 102 by selecting the appropriate concentrate and venturi. The dilution system of the invention includes a container 100 for an aqueous diluent such as service water. The container is typically a molded unit made from a thermoplastic material. Such a unit can be injection molded, vacuum molded or shaped using a variety of conventional thermoplastic processes.

The container 100 is manufactured with an integral base portion 101*a*, 101*b*, etc. to provide a stable positioning of the device in a workplace, in a tub, or in a utility closet. The container has a volume of about 2 to 8 liters, preferably 3 to 6 liters. Such a size permits ease of use, easy transportation from place to place and rapid filling and emptying. Further, the limited capacity of the container limits the weight of the unit to less than 40 lbs (18 kg) preferably less than 25 lbs (10 kg) for easy portability. In normal use to avoid spills, the container can be filled to a fraction of the maximum capacity and can contain an appropriate volume of diluent without filling the container to its maximum depth. The container should have at least 4 and up to 8 centimeters of clearance between the top of the diluent liquid and the upper edge of the container.

When assembled, the dilution system of the invention exposes an open portion of the container. This portion exposes a sufficient area of the upper edge of the container such that water can be easily added to the container from an available source of service water. In use, the apparatus can be placed in a tub, sink, shower, utility closet or other location adjacent to a spout or other source of service water. The service water can be directly added to the container to the desired volume. After the dilution system is used to maintain or clean a single bathroom, the remaining contents of the container can then be emptied to a tub, sink or other disposal location to permit the ease of transport of the system to the next location. In order to permit ease of use of the system of the invention, the container has a portion of the upper edge of the container adapted to pouring or disposing the liquid contents of a container into a tub or sink with minimal spilling, dripping, etc. Preferably, the container can have a lip or spout integrally molded into the container to promote ease of disposal.

Figure 2:
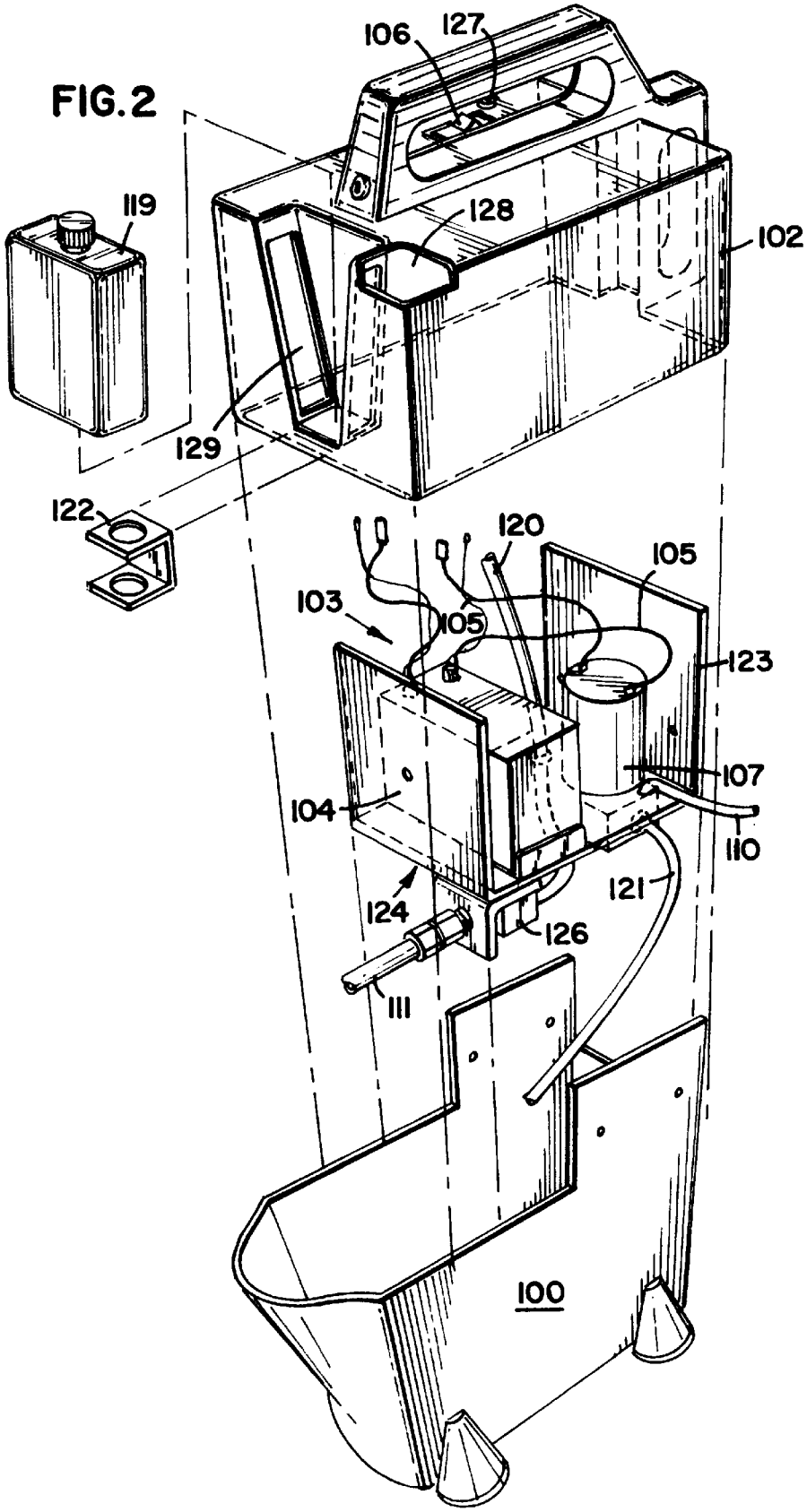

In FIGS. 1 and 2, the dilution section of the dispenser of the invention is shown with a housing 102 over the active components of the apparatus and specifically the dilution section. The housing, similar in formation to the container, is a single part shell molded of a thermoplastic material. The housing has integrally molded handle 115, 116 for ease of transportation, integrally molded stations for the electrical switch 106, the charging jack 127 or docking station for the rechargeable batteries 104, a molded mounting section 129 for the concentrate solution 119 and, if needed, a mounting location 128 for the spray head.

The liquid concentrate container is typically shaped in a rectangular format that is press fit into the mounting site 129 the housing. The volume of the container is about 250–750 milliLiters. The concentrate container is shaped and adapted to be press fit and securely mounted into the housing at location 129. The container 119 is connected in liquid communication via tube 120 with a pump inlet to draw the concentrate for dilution purposes.

In assembling the dilution apparatus of the invention, the dilution section 124 is typically mounted on or above the container not in contact with the diluent. The dilution section has a partition 123 which separates the dry portion from the wet portion. The partition 123 cooperates with the container 100 walls to form a protective barrier between the wet section and the dry section containing the electrical components protecting the electrical components from water damage. The housing is then fit over the dilution section installed in the container and is fixed in place typically using conventional mounting means. The wet section containing the pump, tubes, venturi, and other components that come into contact with the concentrate, the diluent, or components that move those fluids.

The dilution system of the invention comprises a container with a base made of molded legs 101*a*, 101*b*. The dilution system has a housing for the dilution section positioned above the container. The dilution section having a wet portion (not shown) and a dry portion containing rechargeable battery, wiring and connections, a switch, pump connections and other electrical components that are typically kept separate from the water contents of the container. The dilution system of the invention also contains a spray wand containing a valve system for initiating spray, a source of diluted cleaner concentrate and a source of aqueous rinse. The choice of rinse or aqueous diluted concentrate is made using valve 112. The spray wand has a spray head which can provide a variety of spray patterns including a fan pattern, a cone pattern, a direct linear spray. Each spray pattern can be driven in a variety of directions with respect to the position of the spray. The spray can be directed away from the spray head, at a 90° angle from the spray head or any other arbitrary angle in between. The spray can also be directed above, below or to either side of the spray judged from a position of a person holding the spray wand using the molded spray hand hold 114.

When used by maintenance personnel, the unit is grasped by handle or and moved from place to place within the cleaning locus (i.e.) a hospitality or hospital location. The unit is typically placed in a tub or on the floor and filled through opening with sufficient service water or aqueous diluent to service a single bathroom or other location. The container is adapted with an opening and spout to ensure that the container can be easily filled with water or aqueous diluent without disassembling the dilution system apparatus. The apparatus contains a source of liquid concentrate that is placed in liquid connection with the dilution system through tube. When used, the system having source container filled with concentrate and container filled with aqueous liquid, maintenance personnel energizes switch which drives aqueous liquid through tube into the pump. The aqueous liquid leaves pump 107 is driven through a venturi 126 (see FIG. 2) which draws aqueous liquid from source container 119 through tube 120 into the aqueous liquid forming a diluted concentrate. The diluted concentrate is then driven through tube 111 into the spray head 108. Sufficient diluted concentrate is delivered to clean the target surface and the switch 106 is turned off terminating flow of the aqueous liquid and the dilute material. A valve 112 is then switched to a rinse position, the switch is energized drawing aqueous liquid from the container 100 through tube 121 into the pump through tube 110 and out of the spray head to rinse cleaner and soil from the target surface. Once rinsing is complete, the pump switch 106 is turned off terminating the flow of aqueous liquid from the container. The system can be used repeatedly in a bathroom or other room until maintenance operations are finished. At that time the system can be emptied of the aqueous diluent from container by simply pouring the liquid from the container through spout typically into the tub, stool or sink. When the spray wand is no longer in use, the spray wand can be inserted into the holster bracket.

FIG. 2 is an exploded view of the dilution system of the invention. The view shows three major components; the container, the housing and a partition which separates the housing into a wet portion and a dry portion 103. The wet portion on the side of the partition proximate to the container contains the wet portion of the pump, the water intake 121 to the pump 107, the venturi 126 and other portions of the dilution system requiring or permitting contact with water or other aqueous liquids. The dry portion 103 contained within partition comprises the rechargeable battery, the electrical part of the pump, wiring connections 105 to the switch. The housing contains a charging jack 127 for charger apparatus for charging the rechargeable battery. The housing can also contain a holster bracket or a spray wand holder portion in the housing. The bracket or the holder portion can provide storage for the spray wand when the spray wand is not in use. Housing also has a mounting location for the liquid container.

Figure 3:
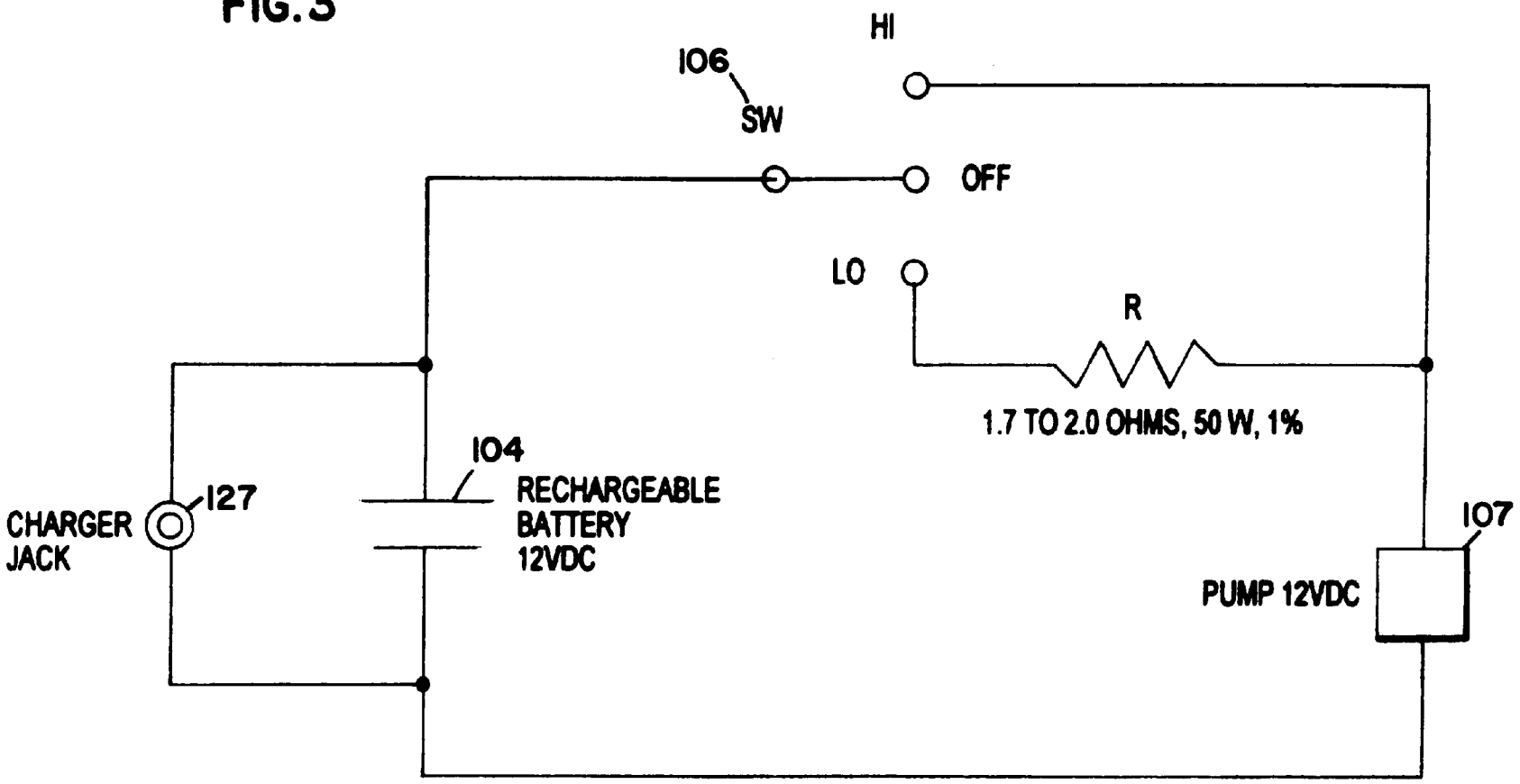

FIG. 3 is an electrical wiring circuit diagram for the dilution system in the invention. The circuit diagram shows the wiring pattern connecting electrically the components of the invention. The charging jack 127 is shown in parallel connection to the rechargeable battery 104. A removable rechargeable battery can be used to energize the system. The multiposition switch 106 has a low and/or a high pumping speed position. The pump 107 is connected to the rechargeable battery directly for the high speed and through a step down resistor for the low speed setting. The container 119 can contain from 250–750 milliLiters of an aqueous or non-aqueous liquid concentrate that can be diluted with the service water in container 100 to form a functional cleaning material for use on surfaces common in the cleaning environment.

Figure 4:
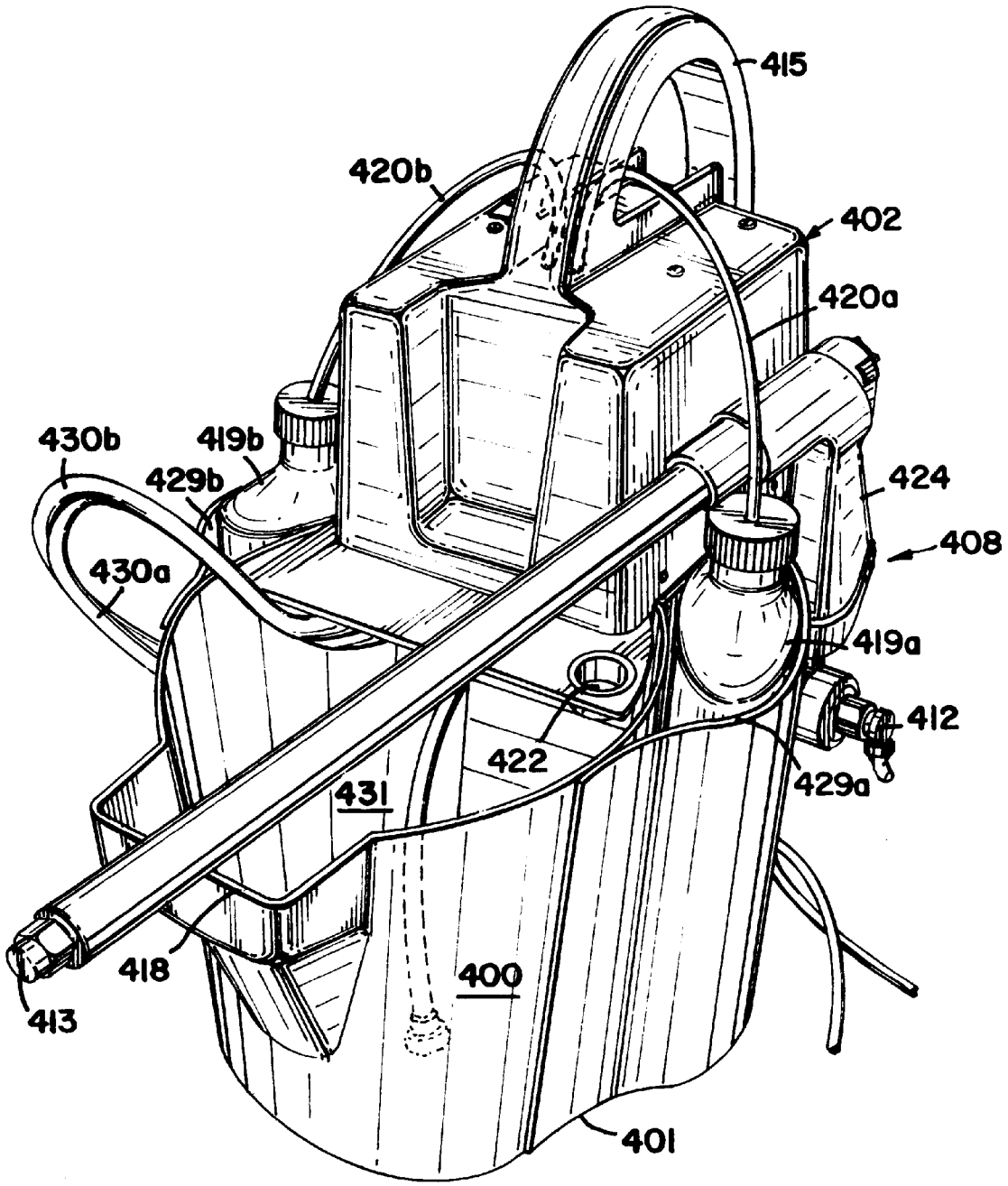

FIG. 4 shows a second embodiment of the invention having two sources of liquid concentrate 419*a* and 419*b* in formed stations 429*a* and 429*b* attached to container 400. Container 400 is divided into a wet section 431 and a dry section 403 (see FIG. 5). Container 400 has a base 401, that can have feet (see feet 101*a* FIG. 1) that permits fluid flow under the unit, that is flat and maintains a reliable placement. Container 400 also has a spout 418 that permits easy filling and emptying of the aqueous diluent. The apparatus comprises a spray wand 408 having a handle 424 and a spray nozzle 413. The diluted concentrate is directed to the wand by conduits 430*a* and 430*b*. The spray nozzle 413 is valved with valve 412 to select either concentrate of container 419*a*, concentrate of container 419*b* or the aqueous diluent in the dry section 431. The electrical components (not shown) are covered by shell 402 that also incorporates a handle 415 and a wand station 422. Concentrate from containers 419*a* and 419*b* are directed into the diluent station through lines 420*a* and 420*b*.

Figure 5:
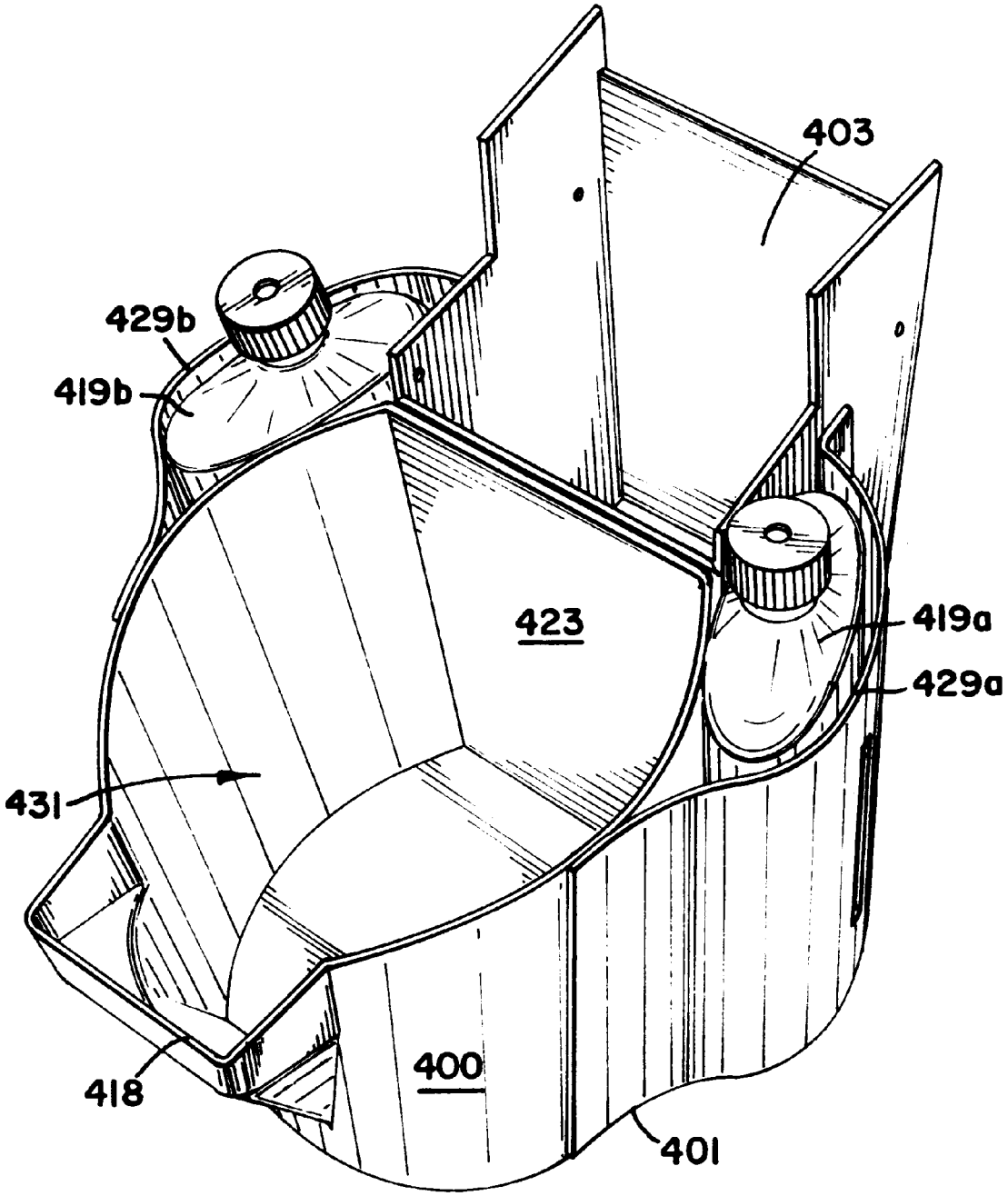
FIG. 5 is an isometric view of the lower portion of the apparatus of the invention with the electrical components and tubing components in an upper portion, removed. Two areas are shown in FIG. 5.

FIG. 5 is an isometric view of the container 400 having wet section 431 and dry section 403 separated by a separation or wall 423. The concentrate containers 419*a* and 419*b* are shown in their mounting locations 429*a* and 429*b*.

Figure 6:
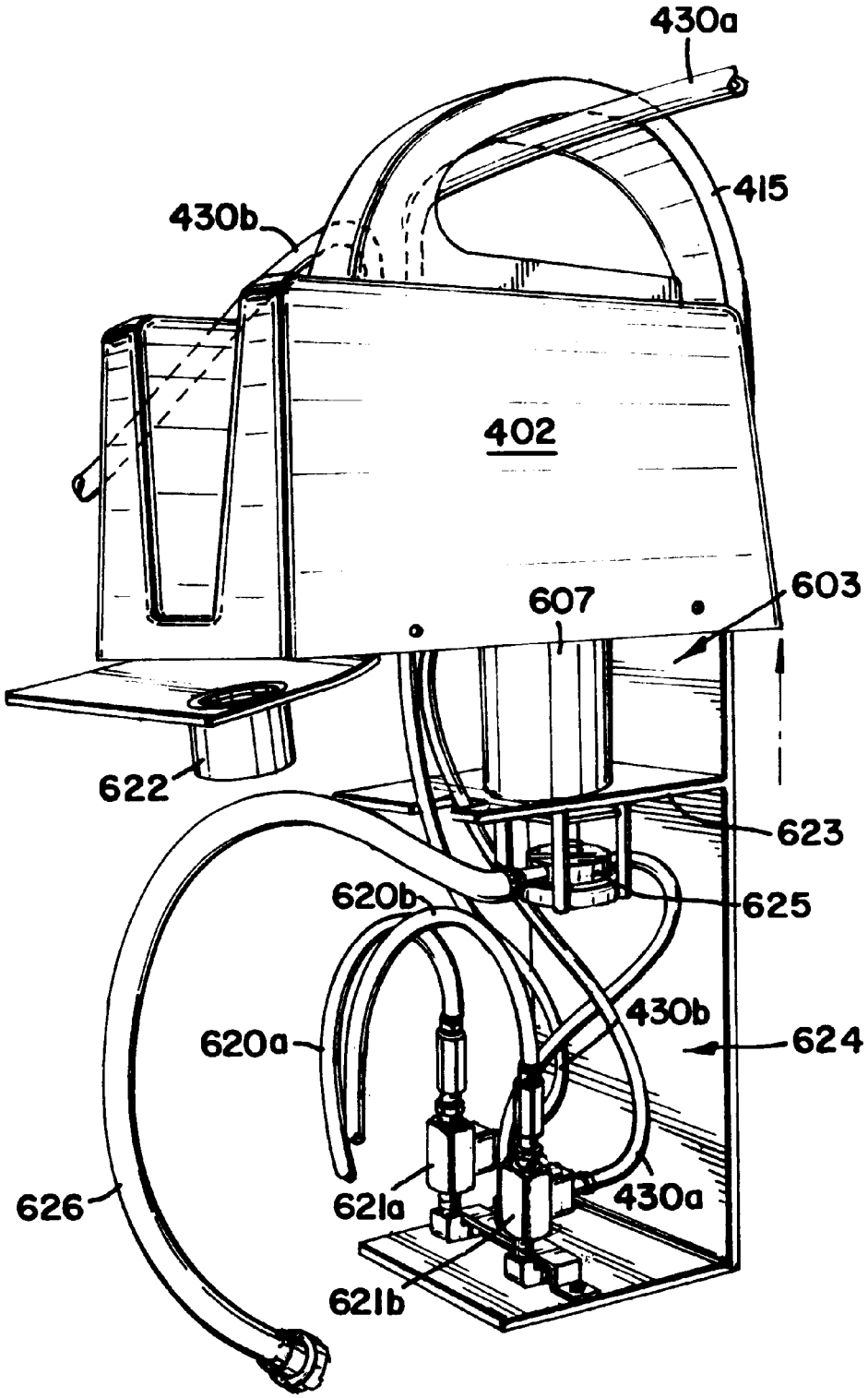
FIG. 6 is a side view of the apparatus of the invention having a lower wet portion and an upper dry portion.

FIG. 6 shows the active portion of the portable system showing a dry section 603 and a wet section 624 separated by a separation of wall 623. Housing 402 is pulled from the dry section 603 to reveal the motor 607. Not shown in the dry section is the rechargeable battery and wiring. In housing 602 is shown handle 415 and wand holder 622. In the operation of the device, liquid concentrate is drawn through tubes 420*a* and 420*b* into venturi 621*a* and 621*b*. Water is picked up from pick-up tube 626, directed through pump 625, past the venturis 621*a* and 621*b* wherein the water mixes with the concentrate to form the use solution which is directed to the wand 408 through tubes 430*a* and 430*b*. The wet section 624 is separated from the dry section 603 using a separator or partition 623.

The typical environments include kitchens, bathrooms, and other locations requiring cleaning. Often these surfaces are metallic, ceramic, glass, plastic and other relatively non-porous hard surfaces that can obtain soils from typical human activities within the environment. The liquid concentrates used by the device of the invention are typically formulated to remove soils common in this environment. Soils can include components from hardness components of service water, food soils, human waste, soap scum and film, common grease, dirt and grime, and other conventional common soils. Examples of the types of concentrated cleaning solutions which may be utilized in the dispensing system of the invention include multipurpose cleaners, for example, for walls, windows, tiles and hard surfaces, germicidal detergents for disinfecting and sanitizing floor care products, specialty products for special cleaning needs and others. However, typically these products are formulated with conventional surfactants but also contain a rinse aid material that, when present in the cleaner, when rinsed, promotes sheeting and complete removal of the rinse composition without spotting or streaking.

The blend ratio or proportions of liquid concentrate to service water is set by the dimensions of the tubes, the venturi and optional metering tips, if used, prior to the venturi pick-up. Metering tips when used, are held within the pick-up tube at some portion between the pick-up and the venturi. Each metering tip or tube installation is sized and configured to correspond to a particular proportioning ratio. The metering tip's internal diameter may be small to promote dilution ratios of 100:1 to 1000:1 or large to permit a dilution ratio of about 5:1 to about 50:1, for example or other intermediate ratios. Highest dilution ratio or flow rate is typically achieved when no metering tip is present in the pick-up tube. The chemical to water ratio for typical janitorial applications typically ranges from about 1:40 to about 1:8 with the ratio dependent on the size of the tubing or metering tip, the viscosity of the chemical concentrate and the operational rate of the pump.

Pumps used in the dilution system of the invention are typically electrically driven gear pumps having a capacity of about 2000 to 4000 milliLiters of aqueous diluent per minute ($mL\text{-}min^{-1}$). The final output of the dilution system depends on the length of the tubing, the flow rate of the spray head, the viscosity of the concentrate and the condition of the rechargeable battery and pump motor. The pressures developed in the system are about 10 to 15 psig at the spray head and about 20 to 22 psig at the pump outlet. The pressure drop across a venturi is about 6 to 8 psig.

The liquid cleaning compositions of this invention are typically formed from a major proportion of water, an acid or base component, a surfactant package that can contain a nonionic, anionic, etc. surfactant, a sequestrant, a cosolvent, a hydrotrope, and other optional ingredients such as dyes, perfumes, etc.

Neutral cleaners are typically aqueous solutions of surfactant materials that are blended in an aqueous solution to have a pH near neutral. Acidic or basic cleaners have a source of acidity or source of alkalinity in combination with the other detergent components. An acidic cleaner comprises an acidic component in a cleaner composition. Examples of useful acids include phosphoric acid, sulfamic acid, acidic acid, hydroxy acidic acid, critric acid, benzoic acid, tartaric acid and the like. Mixtures of such ingredients can provide advantages depending on use locus and soil type.

Basic cleaners typically comprise a source of alkalinity. Both organic and inorganic sources of alkalinity can be used. Inorganic sources of alkalinity include sodium hydroxide (caustic), sodium silicates ($Na_2O:SiO_2$ at 1–100:1), sodium carbonate, etc. Organic sources of alkalinity typically comprise ammonia and organic amines such as methylamine, dimethylamine, hydroxy ethylamine, trihydroxy ethylamine, etc.

The cleaners can comprise a variety of ingredients including anionic, nonionic or cationic surfactant materials, other ingredients, etc. One anionic surfactant useful for detersive purposes can also be included in the compositions hereof. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates. $C_8$–$C_{24}$ alkylpolyglycolethersulfates (containing up to 10 moles of ethylene oxide); alkyl glycerol sulfonates, fatty acyl glycerol sulfonates, fatty oleyl glycerols sulfates, alkyl phenol ethylene oxide ether sulfates, paraffin sulfonates, alkyl phosphates, isethionates such as the acyl isethionates, acyl laurates, fatty acid amides of methyl tauride, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates; sulfates of alkylpolysaccharides such as the sulfates of alkylpolyglucosode (the nonionic nonsulfated compounds being described below), branched primary alkyl, sulfates, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Another type of anionic surfactant which can be utilized encompasses alkyl ester sulfonates. Alkyl ester sulfonate surfactants hereof include linear esters of $C_8$–$C_{20}$ carboxylic acids (i.e., fatty acids) which are sulfonated with gaseous $SO_3$ according to "The Journal of the American Oil Chemists Society." 52 (1975), pp. 323–329. Suitable starting materials would include natural fatty substances as derived from tallow, palm oil, etc. Alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations such as tetramethylammonium and dimethyl piperdinium cations and quaternary ammonium cations derived from alkylamines such as ethylamine, diethylamine, triethylamine, and mixtures thereof, and the like). Alkyl alkoxylated sulfate surfactants hereof are water soluble salts or acids of the formula $RO(A)_mSO_3$-$M^+$ wherein R is an unsubstituted $C_{10}$–$C_{24}$ alkyl or hydroxy alkyl group having a $C_{10}$–$C_{24}$ alkyl component, preferably $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.) ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium cations and quaternary ammonium cations such as tetramethyl-ammonium and dimethyl piperdinium cations and those derived from alkylamines such as ethylamine, diethylamine, triethyl-amine, mixtures thereof, and the like.

Conventional, nonionic detersive surfactants for purposes of this invention include the polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal™ CO-630, marketed by the GAF Corporation; and Triton™ X-45, X-114, X-100, and X-102, all marketed by the Rohm & Haas Company. Nonionic surfactants also include the condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 10 moles of ethylene oxide per mole of alcohol. Examples of commercially available nonionic surfactants of this type include Tergitol™ 15.5.9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.5 moles of ethylene oxide), Neodol™ 45.7 (the condensation product of $C_{14}$–$C_{15}$ linear alcohol with 7 moles of ethylene oxide), Neodol™ 45.4 (the condensation product of $C_{14}$–$C_{15}$ linear alcohol with 4 moles of ethylene oxide), marketed by Shell Chemical Company, and Kyro™ EOB (the condensation product of $C_{13}$–$C_{15}$ alcohol with 9 moles ethylene oxide), marketed by The Procter & Gamble Company. The condensation products of ethylene oxide with a hydrophobic base formed by the condensation of propylene oxide with propylene glycol can also be used. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic™ surfactants, marketed by BASF. Cationic detersive surfactants can also be included in detergent compositions of the present invention. Cationic surfactants include the ammonium surfactants such as alkyldimethylammonium halogenides, and those surfactants having the formula: $[R^2(OR^3)_y][R^4(OR^3)_x]_3R^3N^+X^-$; wherein $R^2$ is an alkyl or alkyl benzyl group having from about 8 to about 18 carbon atoms in the alkyl chain, each $R^3$ is selected from the group consisting of $—CH_3CH_2—$, $—CH_2CH(CH_3)—$, $—CHCH(CH_2OH)—$, $—CH_2CH_2CH_2—$, and mixtures thereof; each $R^4$ is selected from the group consisting of $C_1$–$C_4$ alkyl, $C_1$–$C_4$ hydroxylalkyl, benzyl ring structures formed by joining the two $R^4$ groups, $—CH_2CHOH——CHOHCOR^6CHOHCH_2OH$ wherein $R^6$ is any hexose or hexose polymer having a molecular weight less than about 1000, and hydrogen when y is not O; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Typical Formulations

Degreaser

| RAW MATERIAL | WT % | DESCRIPTION |
|---|---|---|
| Water | q.s. | Diluent |
| Sodium Hydroxide | 10–20 | Alkalinity |
| Sodium Metasilicate | 2–4 | Soft Metal Protection |
| Tetra Sodium EDTA 40% | 1–4 | Chelator |
| Alkyl Poly Glycoside 70% | 1–5 | Surfactant |
| Typical use concentration 6–12 oz/gal | | |

Glass Cleaner

| RAW MATERIAL | WT % | DESCRIPTION |
|---|---|---|
| Deionized Water | q.s. | Diluent |
| Ammonia (40% Active) Aqueous | 2–8 | Ammonia |
| Sodium Lauryl Ether Sulfate 60% | 0.5–1.0 | Anionic Surfactant |
| Ethylene Glycol Butyl Ether | 5–15 | Glycol Ether Solvent |
| Sodium Xylene Sulfonate 40% Liquid | 1–5 | Coupler |
| Typical use concentration 5–10 oz/gal | | |

All Purpose Cleaner

| RAW MATERIAL | WT % | DESCRIPTION |
|---|---|---|
| Deionized Water | q.s. | Diluent |
| Linear Alkyl Sulfonate | 3–9 | Nonionic Surfactant |
| Sodium Lauryl Ether Sulfate | 2–6 | Anionic Surfactant |
| Tetra Sodium EDTA 40% Liquid | 1–3 | Chelator |
| Potassium Hydroxide | <0.5 pH 7.5–9.5 | pH adjustment |
| Typical use concentration 1–4 oz/gal | | |

Heavy Duty Cleaner

| RAW MATERIAL | WT % | DESCRIPTION |
|---|---|---|
| Water | q.s. | Diluent |
| Ethoxylated Nonyl phenols (9.5 mole to 11 mole) | 5–10 | Nonionic Surfactant |
| Tetra Sodium EDTA 40% Liquid | 5–10 | Chelator |
| Sodium Xylene Sulfonic 40% | 5–10 | Coupler |
| Sodium Metasilicate | 1–4 pH 10.5–12.0 | Alkalinity Source |
| Typical use concentration 1–4 oz/gal | | |

Alternate Heavy Duty Cleaner—Biodegradable

| RAW MATERIAL | WT % | DESCRIPTION |
|---|---|---|
| Water | q.s. | Diluent |
| Ethoxylated Alcohol | 5–12 | Nonionic Surfactant |
| Tetra Sodium EDTA | 5–10 | Chelator |
| Sodium Xylene Sulfonic 40% | 3–8 | Coupler |
| Potassium Hydroxide 45% | 0.5–3 pH 9.5–12.0 | Alkalinity Source |
| Typical use concentration 1–4 oz/gal | | |

Disinfectant

| RAW MATERIAL | WT % | DESCRIPTION |
|---|---|---|
| Soft Water | q.s. | Diluent |
| BTC 2125M (50%) | 6.4 | Quaternary Antimicrobial Active |
| Sodium Carbonate | 3.0 | Buffer |
| Nonylphenol Ethoxylate (11 mole) | 2.5 | Nonionic Surfactant |
| Tetra Sodium EDTA (40%) | 2.5 | Chelator |
| Typical use concentration 1–4 oz/gal | | |

Sanitizer

| RAW MATERIAL | WT % | DESCRIPTION |
|---|---|---|
| Soft Water | q.s. | Diluent |
| Alkyl Dimethyl Ammonium Chloride (50%) | 2.5–10 | Active Antimicrobial Agent |
| Typical use concentration 1–4 oz/gal | | |

Acid Cleaner

| RAW MATERIAL | WT % | DESCRIPTION |
|---|---|---|
| Soft Water | q.s. | Diluent |
| Sulfamic Acid | 3.5 | Acid |
| Hydroxyacetic | 7.0 | Acid |
| Diethylene Glycol Monobutyl Ether | 4.0 | Solvent |
| Nonyl Phenol (9.5 mole) EO | 1.0 | Nonionic |

The typical viscosities of these materials is about 0 to 1000 cP, preferably about 10 to 250 cP at 25° C.

The above specification, drawings, chemical formulation information and test data provide a basis for understanding the invention. However, since many embodiments of the invention may be implemented without departing from the spirit and scope of the invention, the invention resides in the claims hereinafter appended.

We claim:

1. A portable self-contained industrial or institutional cleaning system, that can contact surfaces with an aqueous cleaning spray followed by an aqueous rinse spray, the system comprising:

(a) a fillable and emptiable container, for a volume of an aqueous diluent of less than 20 liters, the container having a supporting base and a pour spout;

(b) a dilution section, mounted above the container, having a dry portion and a wet portion, the wet portion proximate the volume of liquid in the container;

(i) the wet portion comprising a venturi and a wet portion of a pump, wherein a pump intake is in liquid communication between the container and a pump inlet, a pump outlet is in liquid communication between the pump and the venturi, the venturi comprising a concentrate inlet and the venturi in liquid communication with an outlet; and (ii) the dry portion of the station comprising a rechargeable battery, a dry portion of the pump and sufficient wiring to power the pump;

(c) a source of aqueous concentrate in liquid communication with the concentrate inlet of the venturi; and (d) spray means in separate liquid communication with the venturi outlet and the pump outlet, the spray means providing a spray pattern, and comprising a valve that can select either a dilute aqueous cleaner or a water rinse;

wherein the pump has a pumping capacity of about 2000 to 3000 mL/min and the system, with the container filled with an effective amount of water, weighs less than 7 kg.

2. The system of claim 1 wherein the system weighs less than 3 kg.

3. The system of claim 1 wherein the container is sized and configured such that the container can be filled from a tub spout in a bathroom.

4. The system of claim 1 wherein the dry portion also comprises a wiring and multiposition switch providing an off position, and at least two power positions having different pump speeds.

5. The system of claim 1 wherein the system comprises two or more sources of diluent and the wet section comprises a venturi for each source of diluent.

6. The system of claim 1 wherein the rechargeable battery has a capacity of greater than 1000 milliamp hours.

7. The system of claim 1 wherein the rechargeable battery comprises a removable rechargeable battery and an internal docking station for the battery.

8. The system of claim 1 wherein the battery can be recharged by connecting the system to a source of charging current.

9. The system of claim 1 wherein the liquid concentrate comprises soil removing detergent formulation comprising a nonionic composition that promotes rapid rinsing of the formulation from the surface.

10. The system of claim 1 wherein the system additionally comprises means to hold and store the spray means.

11. The system of claim 1 wherein the container has a volume for the aqueous liquid of less than 6 liters.

12. The system of claim 1 wherein the container has a volume of about 1 to 10 liters.

13. The system of claim 1 wherein the source of aqueous concentrate is a component formed in the dilution section.

14. The system of claim 1 wherein the pump comprises a gear pump.

15. The system of claim 1 wherein the tubing has an inside diameter of about 5 to 10 millimeters and the system operates at a liquid pressure of about 0.5 to 1 kPa.

16. The system of claim 1 wherein the spray pattern comprises a conical spray.

17. The system of claim 1 wherein the spray pattern comprises a fan shaped spray pattern.

* * * * *